US007716941B2

(12) United States Patent
Park et al.

(10) Patent No.: US 7,716,941 B2
(45) Date of Patent: May 18, 2010

(54) MULTI-TYPE AIR CONDITIONER WITH DEFROSTING DEVICE

(75) Inventors: Jong Han Park, Gyeonggi-do (KR); Young Min Park, Incheon-si (KR); Chang Seon Lee, Seoul (KR); Sung Oh Choi, Gyeonggi-do (KR); Sung Chun Kim, Seoul (KR); Seung Yong Chang, Seoul (KR); Seok Ho Yoon, Seoul (KR); Baik Young Chung, Incheon-si (KR)

(73) Assignee: LG Electronics Inc., Seoul (KR)

( * ) Notice: Subject to any disclaimer, the term of this patent is extended or adjusted under 35 U.S.C. 154(b) by 331 days.

(21) Appl. No.: 11/678,974

(22) Filed: Feb. 26, 2007

(65) Prior Publication Data

US 2007/0130967 A1 Jun. 14, 2007

Related U.S. Application Data

(62) Division of application No. 10/726,622, filed on Dec. 4, 2003, now Pat. No. 7,308,800.

(30) Foreign Application Priority Data

Jan. 13, 2003 (KR) ..... 10-2003-0002040

(51) Int. Cl.
*F25B 47/00* (2006.01)

(52) U.S. Cl. ..... 62/277; 62/87; 62/513

(58) Field of Classification Search ..... 62/277, 62/151, 324.1, 513
See application file for complete search history.

(56) References Cited

U.S. PATENT DOCUMENTS 4,313,313 A 2/1982 Chrostowski et al.
4,565,070 A * 1/1986 Raymond ..... 62/81
4,949,551 A 8/1990 Gregory
5,092,134 A 3/1992 Tagashira et al.
5,150,582 A 9/1992 Gotou
5,159,817 A 11/1992 Hojo et al.
5,309,733 A 5/1994 Hayashida et al.
5,771,699 A * 6/1998 Ponder ..... 62/81

(Continued)

FOREIGN PATENT DOCUMENTS

EP 1197710 4/2002

(Continued)

*Primary Examiner*—Melvin Jones
(74) *Attorney, Agent, or Firm*—McKenna Long & Aldridge LLP

(57) ABSTRACT

Multi-type air conditioner comprising an outdoor unit installed in an outdoor, comprising a compressor, a refrigerant flow controlling part connected to a discharge end of the compressor for guiding the refrigerant proper to operation conditions selectively, an outdoor heat exchanger connected to the refrigerant flow controlling part, a defrosting device at a side of the outdoor heat exchanger, and a piping system connected between the parts, a plurality of indoor units each installed in a room and having an indoor heat exchanger and an electronic expansion valve having one end connected to one end of the indoor heat exchanger, and a distributor between the outdoor unit and the indoor units for selectively guiding refrigerant from the outdoor unit to the plurality of indoor units proper to operation conditions, and guiding the refrigerant passed through the indoor units to the outdoor unit again.

7 Claims, 9 Drawing Sheets

U.S. PATENT DOCUMENTS

| | | | | |
|---|---|---|---|---|
| 6,244,057 | B1 | 6/2001 | Yoshida et al. | |
| 6,393,858 | B1 | 5/2002 | Mezaki et al. | |
| 6,666,043 | B2 | 12/2003 | Lee | |
| 6,918,264 | B2 * | 7/2005 | Park et al. | 62/324.1 |
| 7,308,800 | B2 * | 12/2007 | Park et al. | 62/159 |
| 2004/0003604 | A1 | 1/2004 | So et al. | |

FOREIGN PATENT DOCUMENTS

| | | |
|---|---|---|
| JP | 57-71699 | 5/1982 |
| JP | 62-123264 | 6/1987 |
| JP | 05-172431 | 7/1993 |

* cited by examiner

MULTI-TYPE AIR CONDITIONER WITH DEFROSTING DEVICE

This application is a divisional of pending U.S. application Ser. No. 10/726,622 filed Dec. 4, 2003, which claims the benefit of the Korean Application No. P2003-0002040 filed on Jan. 13, 2003, which is hereby incorporated by reference.

BACKGROUND OF THE INVENTION

1. Field of the Invention

The present invention relates to multi-type air conditioners, and more particularly, to a defrosting device for removal of frost formed during heating operation from an outdoor heat exchanger, and a multi-type air conditioner with the defrosting device.

2. Background of the Related Art

In general, the air conditioner, an appliance for cooling or heating room spaces, such as living spaces, restaurants, and offices, cools or heats the room space by circulating refrigerant with a compressor and heat exchangers.

The air conditioner succeeds to development of a multi-type air conditioner which can cool or heat rooms at the same time without being influenced from an external temperature or environment for maintaining more comfortable room environments, resulting to cool or heat entire rooms under the same operation mode.

A related art multi-type air conditioner is provided with one or more than one outdoor unit connected to a plurality of indoor units installed in respective rooms, and operative only in one mode of cooling or heating for controlling room temperatures.

However, nowadays, as the room space becomes larger, a room structure becomes complex, and positions and services of rooms are diversified, room environments of the rooms differ from one another. Particularly, a room equipped with machinery or computer has a room temperature higher than other rooms due to heat from operation of the equipment.

Consequently, as some of the rooms require cooling, while other rooms require heating, the related art multi-type air conditioner can not deal with.

Moreover, in a case the multi-type air conditioner is operated in a heating mode, frost is formed on the outdoor heat exchanger in the outdoor unit caused by cooled down environmental air, which drops an air conditioning efficiency of the air conditioner. Since it is required to shift to the operation mode to cooling for removing the frost from the outdoor heat exchanger, no heating is available during a defrosting operation.

According to above requirement, development of a multi-type air conditioner of concurrent cooling and heating type is required.

For improving the air conditioning efficiency of the air conditioner, development of a multi-type air conditioner with a defrosting device for removal of frost formed during heating operation from the outdoor heat exchanger.

SUMMARY OF THE INVENTION

Accordingly, the present invention is directed to a defrosting device, and a multi-type air conditioner with the defrosting device that substantially obviates one or more of the problems due to limitations and disadvantages of the related art.

An object of the present invention is to provide an air conditioner which can cool some of rooms, and heats rest of the rooms depending on respective room environments.

Another object of the present invention is to provide a defrosting device which can remove frost, formed in a heating operation, from an outdoor heat exchanger, for improving air conditioning efficiency, and a multi-type air conditioner with the defrosting device.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the defrosting device comprising a defrosting heat exchange means at one side of an outdoor heat exchanger in a multi-type air conditioner that can cool or heat rooms, having one end connected to a pipeline for flow of high pressure gas refrigerant from a compressor, and the other end connected to a pipeline connected to one end of an outdoor heat exchanger in the multi-type air conditioner for flow of high pressure liquid refrigerant.

The defrosting heat exchange means comprises a first guide pipeline having one end connected to a pipeline for flow of high pressure gas refrigerant, and the other end connected to one end of a defrosting heat exchanger, for guiding the high pressure gas refrigerant in a defrosting operation, the defrosting heat exchanger having one end connected to the other end of the first guide pipeline, and a second guide pipeline having one end connected to the other end of the defrosting heat exchanger, and the other end connected to the pipeline for flow of the high pressure liquid refrigerant.

The first guide pipeline further comprises an electronic valve mounted thereon for controlling a flow rate of the refrigerant from the high pressure gas refrigerant pipeline in the defrosting operation.

The defrosting device further comprises a first bypass pipe having one end connected to a pipeline in the multi-type air conditioner for flow of low pressure gas refrigerant, and the other end connected to the first guide pipeline, a first three way valve on an intersection of the first bypass pipe and the first guide pipeline for changing a flow direction of the refrigerant according to an operation mode, a second bypass pipe having one end connected to a pipeline for flow of the high pressure liquid refrigerant, and the other end connected to the second guide pipeline, and a second three way valve on an intersection of the second guide pipeline and the bypass pipe for changing a flow direction of the refrigerant according to the operation mode.

In another aspect of the present invention, there is provided a multi-type air conditioner comprising an outdoor unit installed in an outdoor, comprising a compressor, a refrigerant flow controlling part connected to a discharge end of the compressor for guiding the refrigerant proper to operation conditions selectively, an outdoor heat exchanger connected to the refrigerant flow controlling part, a defrosting device at a side of the outdoor heat exchanger, and a piping system connected between the parts, a plurality of indoor units each installed in a room and having an indoor heat exchanger and an electronic expansion valve having one end connected to one end of the indoor heat exchanger, and a distributor between the outdoor unit and the indoor units for selectively guiding refrigerant from the outdoor unit to the plurality of indoor units proper to operation conditions, and guiding the refrigerant passed through the indoor units to the outdoor unit again.

The piping system comprises a first connection pipeline connected to a discharge end of the compressor and has the other end connected to the distributor, and the refrigerant flow controlling part and the outdoor heat exchanger mounted between the ends in succession, a second connection pipeline connected to the first connection pipeline which is connected between the refrigerant flow controlling part and the discharge end of the compressor for guiding compressed refrigerant to the distributor directly, and a third connection pipeline connected between a suction end of the compressor and the distributor having a branch pipeline connected to one end of the refrigerant flow controlling part, for guiding low pressure gas refrigerant to the compressor.

The refrigerant flow controlling part is a four way valve for selective guidance of the refrigerant from the compressor to the outdoor heat exchanger or the distributor proper to operation condition.

The distributor comprises a guide piping system for guiding the refrigerant introduced thereto through the first connection pipeline or the second connection pipeline in the outdoor unit to the indoor units, and the refrigerant from the indoor units to the first connection pipeline or to the third connection pipeline in the outdoor unit, and a valve bank on the guide piping system for controlling refrigerant flow such that the refrigerant flows in/out of the indoor units, selectively.

The defrosting device has one end connected to the second connection pipeline, and the other end connected to a first connection pipeline between the distributor and the outdoor heat exchanger.

The defrosting device comprises a first guide pipeline having one end connected to the second connection pipeline for guiding refrigerant from the second connection pipeline, a defrosting heat exchanger having one end connected to the other end of the first guide pipeline, and a second guide pipeline having one end connected to the other end of the defrosting heat exchanger, and the other end connected to the first connection pipeline between the distributor and the outdoor heat exchanger.

The defrosting device further comprises an electronic valve on the first guide pipeline for controlling a flow rate of the refrigerant from the second connection pipeline.

The operation condition comprises a first mode for cooling all rooms, a second mode for cooling a major number of rooms and heating a minor number of rooms, a third mode for heating all rooms, a fourth mode for heating a major number of rooms and cooling a minor number of rooms, a fifth mode for making an operation for defrosting from the outdoor heat exchanger at the same time with the third mode operation, and a sixth mode for making an operation for defrosting from the outdoor heat exchanger at the same time with the fourth mode operation.

The outdoor unit further comprises a check valve on the first connection pipeline between the distributor and the outdoor heat exchanger for passing refrigerant from the outdoor unit toward the distributor in the first or second mode operation, and a heating parallel expansion pipe having a refrigerant expansion element in parallel to the check valve for guiding refrigerant introduced from the distributor through the first connection pipeline to the outdoor heat exchanger in the third to sixth mode operation.

The second guide pipeline is connected to the first connection pipeline between the heating parallel expansion pipe and the distributor.

The defrosting device further comprises a bypass pipe having one end connected to a first connection pipeline between the four way valve and the outdoor heat exchanger, and the other end connected to the first guide pipeline, a three way valve on an intersection of the first bypass pipe and the first guide pipeline for converting a flow direction of the refrigerant according to an operation mode, and an expansion means on the second guide pipeline for expanding refrigerant introduced from the distributor, thereby making the defrosting heat exchanger to serve as an evaporator together with the outdoor heat exchanger in the third or fourth mode.

Alternatively, the defrosting device further comprises a first bypass pipe having one end connected to a first connection pipeline connected between the four way valve and the outdoor heat exchanger, and the other end connected to the first guide pipeline, a first three way valve on an intersection of the first bypass pipe and the first guide pipeline for changing a flow direction of the refrigerant according to an operation mode, a second bypass pipe having one end connected to a first connection pipeline between the outdoor heat exchanger and the heating parallel expansion pipe, and the other end connected to the second guide pipeline, and a second three way valve on an intersection of the second guide pipeline and the bypass pipe for changing a flow direction of the refrigerant according to the operation mode, thereby making the defrosting heat exchanger to serve as an evaporator together with the outdoor heat exchanger in the third or fourth mode.

The outdoor unit further comprises an outdoor fan at a side of the outdoor heat exchanger. For enhancing a defrosting effect, the outdoor unit further comprises an outdoor fan is mounted to blow air from a side of the defrosting heat exchanger to a side of the outdoor heat exchanger.

Thus, according to the present invention, a multi-type air conditioner can be provided which permits some of the rooms operated in a cooling mode and other rooms operated in a heating mode proper to respective room environments, and by removing frost from the outdoor heat exchanger with a defrosting device at a side of the outdoor heat exchanger in heating, an air conditioning efficiency can be improved.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are comprised to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

For better understanding of the present invention, functions of the multi-type air conditioner of concurrent cooling and heating type will be described at first. The air conditioner serves to control temperature, humidity, air motion, cleanliness of air in a particular area suitable to purpose of use. For an example, the air conditioner serves to cool or heat a residential space or a room space, such as an office, restaurant, and the like.

In such a multi-type air conditioner, in a cooling operation, the room is cooled as low pressure refrigerant having heat absorbed from the room is compressed to a high pressure and discharges heat to an outdoor air, and in a heating operation, a process opposite above process is made.

Since the related art multi-type air conditioner cools or heats all rooms uniformly, the multi-type air conditioner of the present invention suggests differing operation conditions proper to respective room states. Moreover, as the multi-type air conditioner of the present invention is provided with the defrosting device described later, an air conditioning efficiency can be improved. A basic system of the multi-type air conditioner with the defrosting device is illustrated in FIG. 1.

Figure 1:
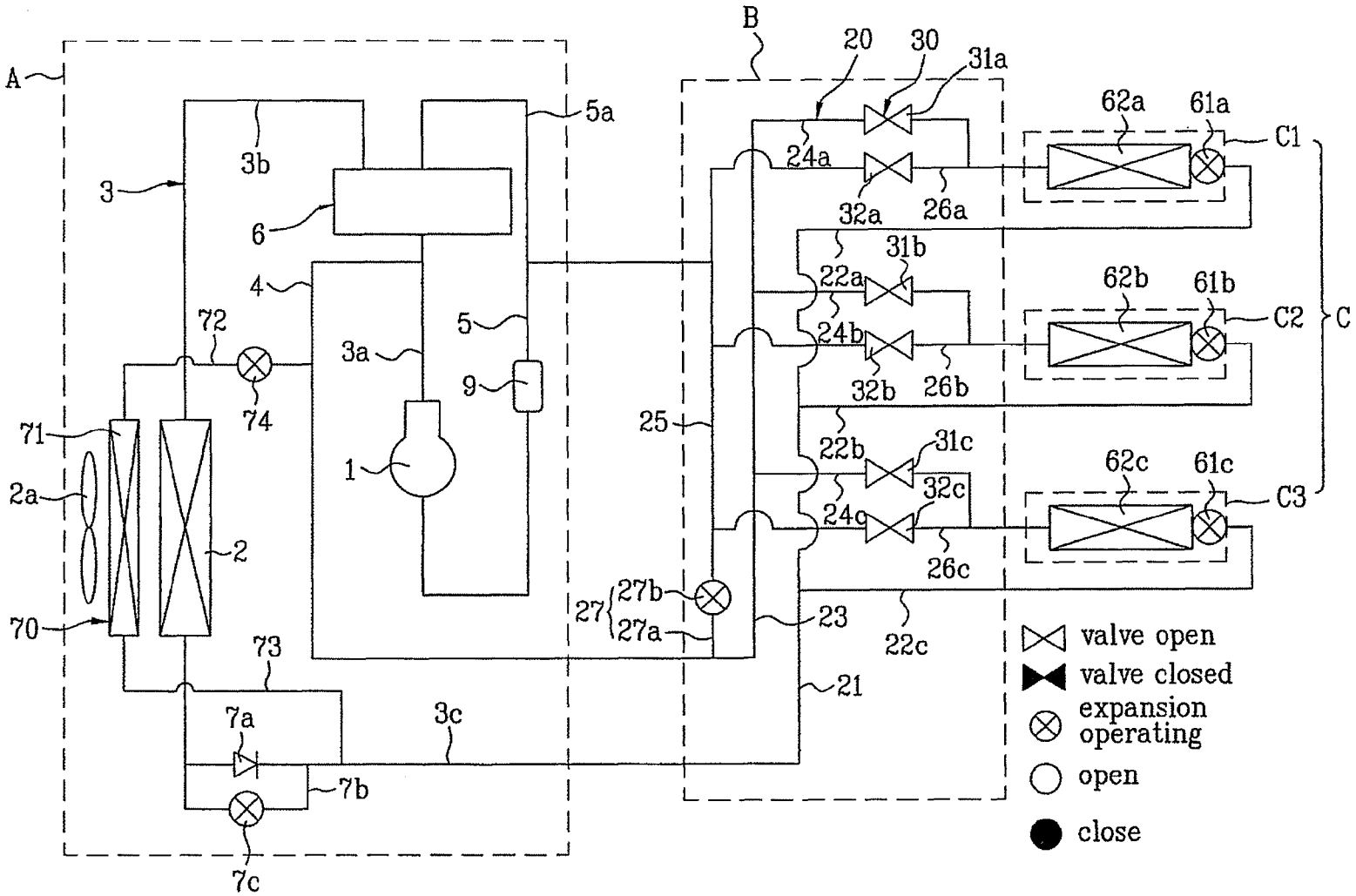
FIG. 1 illustrates a diagram of a basic system of a multi-type air conditioner with a defrosting device in accordance with a preferred embodiment of the present invention.

Referring to FIG. 1, the multi-type air conditioner with a defrosting device comprises an outdoor unit 'A', a distributor 'B', and indoor units 'C'. For convenience of description, only three indoor units are shown.

The outdoor unit 'A' comprises a compressor 1, a refrigerant flow controlling part 6 connected to a discharge end of the compressor for guiding the refrigerant proper to operation conditions selectively, an outdoor heat exchanger 2 connected to the refrigerant flow controlling part, a defrosting device 70 at a side of the outdoor heat exchanger, and a piping system connected between the parts.

The piping system comprises a first connection pipeline 3 connected to a discharge end of the compressor 1 and has the other end connected to the distributor 'B' and the refrigerant flow controlling part 6 and the outdoor heat exchanger 2 mounted between the ends in succession, a second connection pipeline 4 connected to the first connection pipeline 3*a* which is connected between the refrigerant flow controlling part 6 and the discharge end of the compressor 1 for guiding compressed refrigerant to the distributor directly, and a third connection pipeline 5 connected between a suction end of the compressor 1 and the distributor 'B' having a branch pipeline 5*a* connected to one end of the refrigerant flow controlling part 6, for guiding low pressure gas refrigerant to the compressor.

The outdoor unit further comprises a check valve 7*a* on the first connection pipeline 3*c* between the distributor and the outdoor heat exchanger for passing refrigerant toward the distributor in a cooling mode, and a heating parallel expansion pipe 7*b* having a refrigerant expansion element 7*c* in parallel to the check valve for guiding refrigerant introduced from the distributor through the first connection pipeline to the outdoor heat exchanger 2.

Each of the indoor units 'C' is installed in each of rooms, and has an indoor heat exchanger 62 and an electronic expansion valve having one end connected to one end of the indoor heat exchanger.

A reference symbol 3 represents 3*a*, 3*b*, and 3*c*, 'C' represents C1, C2, and C3, 61 represents 61*a*, 61*b*, and 61*c*, and 62 represents 62*a*, 62*b*, and 62*c*.

The distributor, between the outdoor unit and the indoor units, guides the refrigerant from the outdoor unit 'A' to the plurality of indoor units C1, C2, and C3 selectively proper to respective operation conditions, and guides the refrigerant passed through the indoor units to the outdoor unit.

The distributor comprises a guide piping system for guiding the refrigerant introduced thereto through the first connection pipeline 3 or the second connection pipeline 4 in the outdoor unit 'A' to the indoor units 'C', and the refrigerant from the indoor units 'C' to the first connection pipeline 3 or to the third connection pipeline 5 in the outdoor unit, and a valve bank 30 on the guide piping system 20 for controlling refrigerant flow such that the refrigerant flows in/out of the indoor units, selectively.

The guide piping system comprises a high pressure liquid refrigerant connection pipeline 21 having one end connected to the first connection pipeline in the outdoor unit, high pressure liquid refrigerant branch pipelines 22 having one ends branched from the high pressure liquid refrigerant connection pipeline as many as a number of the indoor units 'C' and the other ends connected to the other ends of the indoor electronic expansion valves 61 respectively, a high pressure gas refrigerant connection pipeline 23 having one end connected to the second connection pipeline in the outdoor unit directly, high pressure gas refrigerant branch pipelines 24 having one ends branched from the high pressure gas refrigerant connection pipeline as many as the number of the indoor units, and the other ends directly connected to the other ends of the indoor heat exchangers 62 respectively, a low pressure gas refrigerant connection pipeline 25 having one end connected to the third connection pipeline 5 in the outdoor unit directly, and a low pressure gas refrigerant branch pipelines 26 having one ends branched from the low pressure gas refrigerant connection pipeline as many as the number of indoor units, and the other ends connected to the other ends of the indoor heat exchangers the high pressure gas refrigerant branch pipelines 24 connected thereto, respectively.

The valve bank 30 comprises selection valves 31 and 32 on the high pressure gas refrigerant branch pipelines 24 and the low pressure gas refrigerant branch pipelines 26 for closing the valves 31 on the high pressure gas refrigerant branch pipelines and opening the valves 32 on the low pressure gas refrigerant branch pipelines in a case of room cooling, and opening/closing the valves in an opposite manner in a case of room heating, for controlling refrigerant flow.

It is preferable that the distributor further comprises liquefaction preventing device between the second connection pipeline and the low pressure gas refrigerant connection pipeline for preventing liquefaction of high pressure gas refrigerant staying in the second connection pipeline in the mode for cooling all rooms.

Referring to FIG. 1, the liquefaction preventing device comprises a supplementary pipeline 27*a* connected between the second connection pipeline and the low pressure gas refrigerant connection pipeline, and an electronic expansion valve 27*b* on the supplementary pipeline for adjusting opening to convert the refrigerant staying in the second connection pipeline 4 into low pressure gas refrigerant.

A reference symbol 22 represents 22*a*, 22*b*, and 22*c*, a reference symbol 24 represents 24*a*, 24*b*, and 24*c*, a reference symbol 26 represents 26*a*, 26*b*, and 26*c*, a reference symbol 27 represents 27*a*, 27*b*, and 27*c*, a reference symbol 31 represents 31*a*, 31*b*, and 31*c*, and a reference symbol 32 represents 32*a*, 32*b*, and 32*c*.

The defrosting device 70 in the outdoor unit has one end connected to the second connection pipeline, and the other end connected to the first connection pipeline between the distributor and the outdoor heat exchanger.

Necessity of the defrosting device will be described before starting description of the defrosting device in detail.

In general, when the multi-type air conditioner is operated in a heating mode, the outdoor heat exchanger, serving as an evaporator, forms frost on a surface thereof, which can drop an air conditioning efficiency of the multi-type air conditioner. Though the frost can be removed from the outdoor heat exchanger with a heater provided separately, this requires additional energy consumption. Accordingly, the multi-type air conditioner of the present invention employs, not the separate heater, but the following defrosting device.

The defrosting device comprises a first guide pipeline 72 connected to the second connection pipeline for guiding the refrigerant from the second connection pipeline, a defrosting heat exchanger 71 having one end connected to the other end of the first guide pipeline, and a second guide pipeline 73 having one end connected to the other end of the defrosting heat exchanger 71, and the other end connected to the first connection pipeline between the distributor and the outdoor heat exchanger.

It is preferable that the defrosting device further comprises an electronic valve 74 on the first guide pipeline for controlling a flow rate of the refrigerant from the second connection pipeline. Once, the electronic valve is comprised further, when the defrosting device is in operation, entering of the liquid refrigerant into the indoor heat exchanger from the first connection pipeline 3*c* via the defrosting heat exchange 71 caused by a flow rate difference can be prevented effectively.

It is preferable that the second guide pipeline 73 is connected to the first connection pipeline 3 at a position between the heating parallel expansion pipe 7*b* and the distributor.

The operation mode of the multi-type air conditioner comprises a first mode for cooling all rooms, a second mode for cooling a major number of rooms and heating a minor number of rooms, a third mode for heating all rooms, a fourth mode for heating a major number of rooms and cooling a minor number of rooms, a fifth mode for operating the defrosting device in the third mode for defrosting from a surface of the outdoor heat exchanger, and a sixth mode for operating the defrosting device in the fourth mode for defrosting from a surface of the outdoor heat exchanger.

For enhancing the defrosting effect, it is preferable that the outdoor unit 'A' further comprises an outdoor fan 2*a* at a outdoor heat exchanger side. It is also preferable that the outdoor fan blow air from a defrosting heat exchanger side to the outdoor heat exchanger side.

Figure 8:
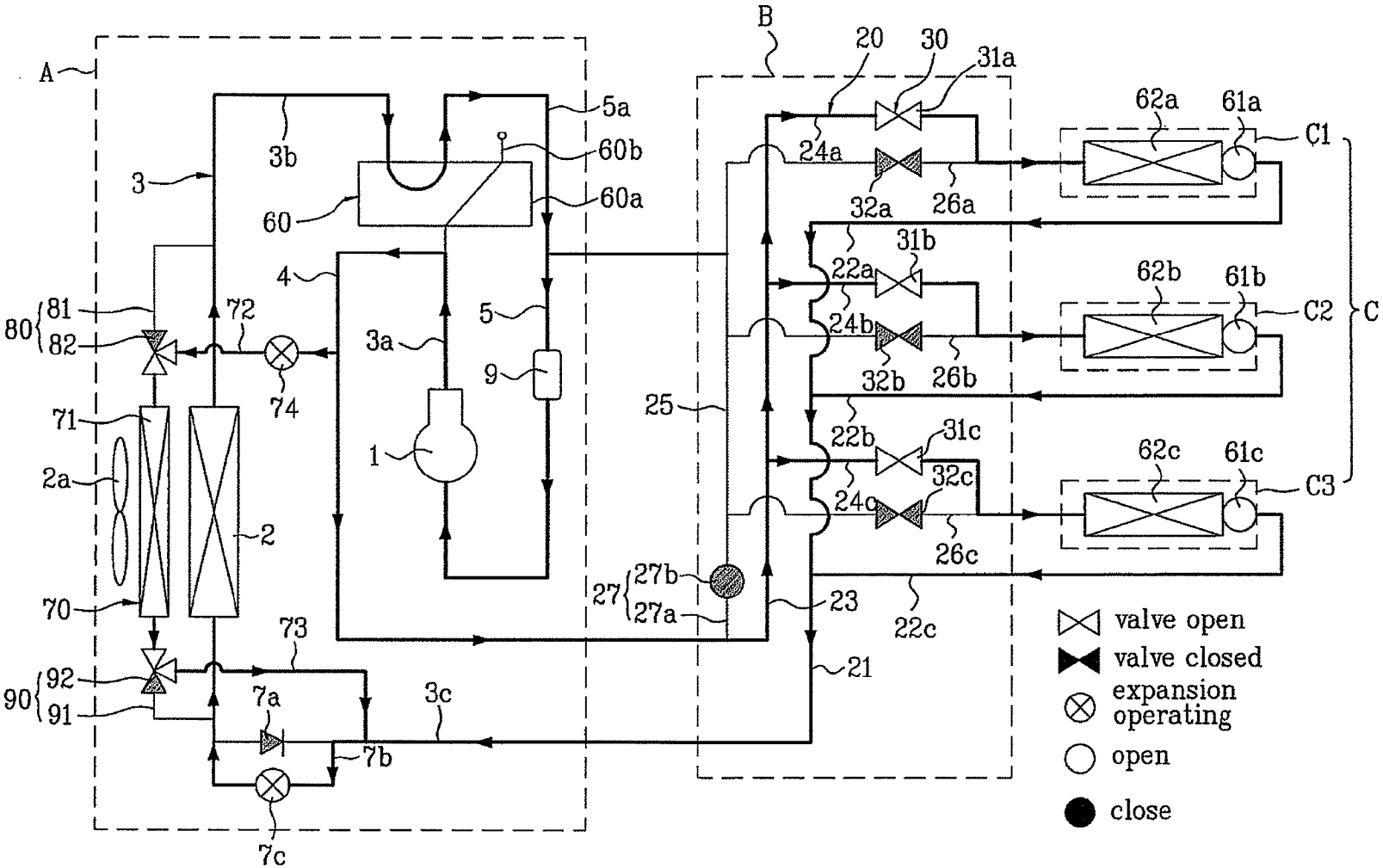
FIG. 8 illustrates a diagram showing a state a multi-type air conditioner with a defrosting device in accordance with a first preferred embodiment of the present invention is operated in a third mode, and the defrosting device is in operation.

The multi-type air conditioner with a defrosting device in accordance with another preferred embodiment of the present invention will be described, with reference to FIGS. 2 and 8. Description of same parts and operation will be omitted.

Since the multi-type air conditioner with a defrosting device in accordance with the following first or second preferred embodiment of the present invention is identical to the basic embodiment of the present invention except the defrosting device, only description of the defrosting device will be given.

In the following first or second embodiment of the present invention, the refrigerant flow controlling part is a four way valve 60 for selectively guiding the refrigerant from the compressor to the outdoor heat exchanger 2 or to the distributor depending on an operation condition.

The defrosting device in the outdoor unit of a multi-type air conditioner in accordance with a first preferred embodiment of the present invention has the following system.

Figure 2:
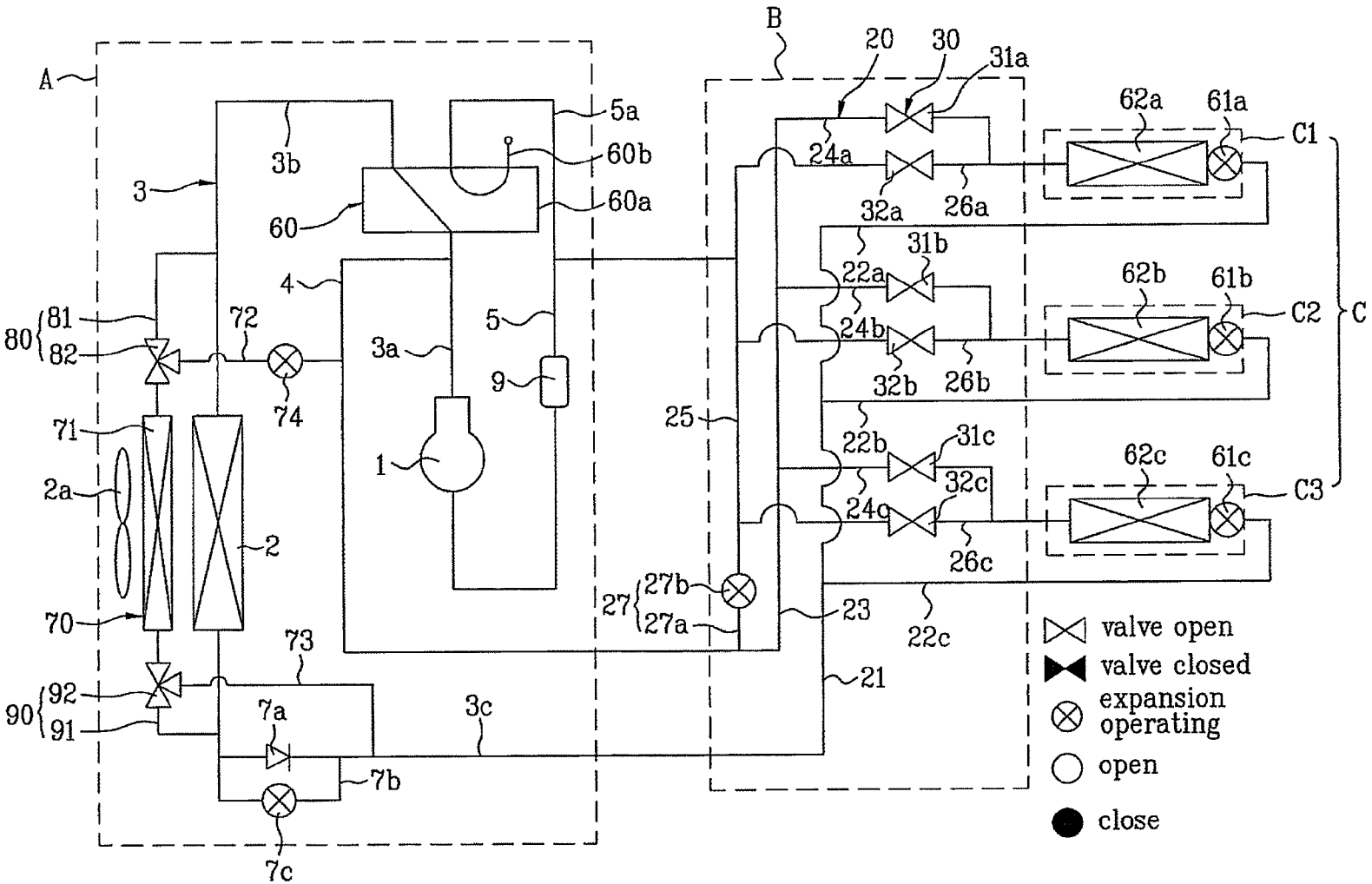
FIG. 2 illustrates a diagram of a multi-type air conditioner with a defrosting device in accordance with a first preferred embodiment of the present invention.

Referring to FIG. 2, the defrosting device 70 comprises a first guide pipeline 72 having one end connected to the second connection pipeline 4 for controlling a flow rate of the refrigerant from the second connection pipeline, a defrosting heat exchanger 71 having one end connected to the other end of the first guide pipeline, and a second guide pipeline 73 having one end connected to the other end of the defrosting heat exchanger, and the other end connected to the first connection pipeline 3*c* between the distributor 'B' and the outdoor heat exchanger 2.

It is preferable that the second guide pipeline 73 is connected to the first connection pipeline at a position between the heating parallel expansion pipe 7*b* and the distributor 'B'.

Moreover, for making the defrosting heat exchanger 71 to serve as an evaporator together with the outdoor heat exchanger in the third or fourth mode, it is preferable that the defrosting device 70 further comprises a first bypass pipe 81 having one end connected to the first connection pipeline 3*b* connected between the four way valve 60 and the outdoor heat exchanger, and the other end connected to the first guide pipeline 72, a first three way valve 82 on an intersection of the first bypass pipe 81 and the first guide pipeline 72 for changing a refrigerant flow path proper to respective operation modes, a second bypass pipe 91 having one end connected to the first connection pipeline 3*c* between the outdoor heat exchanger 2 and the heating parallel expansion pipe 7*b*, and the other end connected to the second guide pipeline 73, and a second three way valve 92 on an intersection of the second guide pipeline 73 and the second bypass pipe 91 for changing refrigerant flow path proper to respective operation modes.

Figure 3:
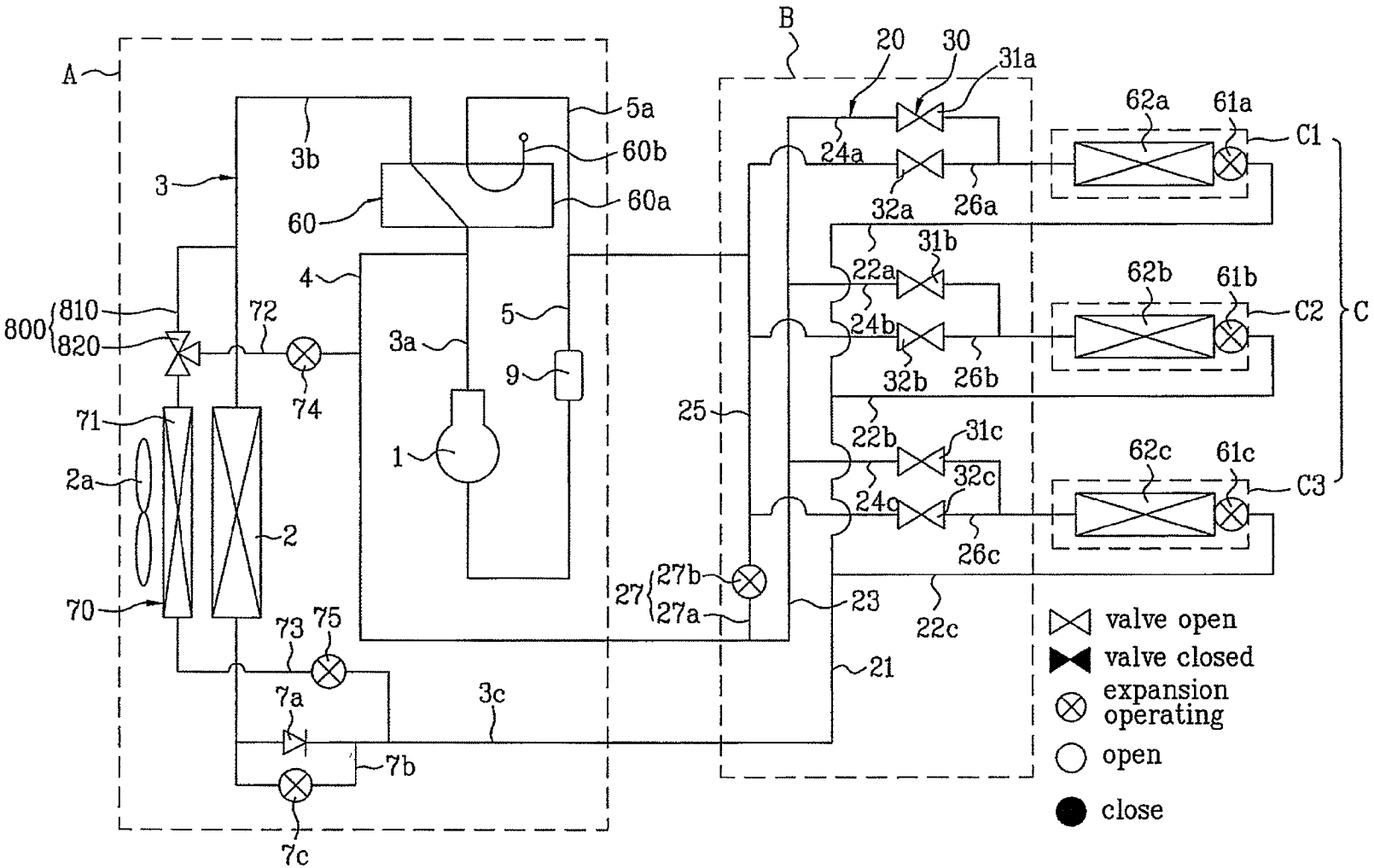
FIG. 3 illustrates a diagram of a multi-type air conditioner with a defrosting device in accordance with a second preferred embodiment of the present invention.

Referring to FIG. 3, as a second embodiment of the present invention, for making the defrosting heat exchanger 71 to serve as an evaporator together with the outdoor heat exchanger 2 in the third or fourth mode, it is preferable that the defrosting device 70 may further comprises a bypass pipe 810 having one end connected to the first connection pipeline 3*b* connected between the four way valve 60 and the outdoor heat exchanger, and the other end connected to the first guide pipeline 72, a three way valve 820 on an intersection of the first bypass pipe 810 and the first guide pipeline 72 for changing a refrigerant flow path proper to respective operation modes, and expansion means on the second guide pipeline 73 for expanding refrigerant from the distributor 'B'. It is preferable that the expansion means comprises an electronic expansion valve 75.

Refrigerant flow in the multi-type air conditioner in accordance with a first preferred embodiment of the present invention will be described with reference to FIGS. 4~9.

Figure 4:
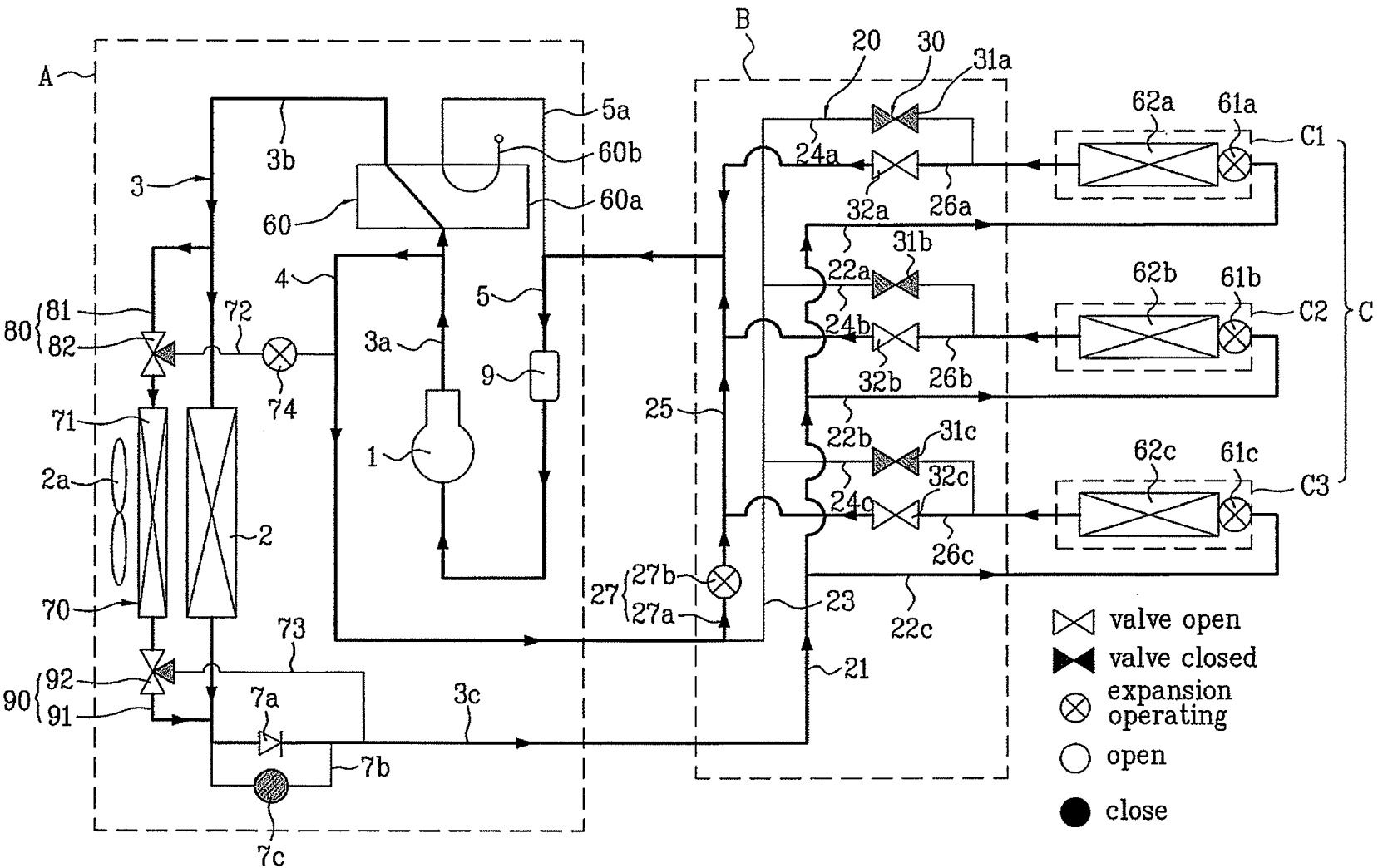
FIG. 4 illustrates a diagram showing a state a multi-type air conditioner with a defrosting device in accordance with a first preferred embodiment of the present invention is operated in a first mode.

Referring to FIG. 4, the refrigerant flow of the multi-type air conditioner in accordance with a first preferred embodiment of the present invention in the first mode will be described.

Most of the high pressure refrigerant discharged from the compressor 1 is introduced into the four way valve 60 through the first connection pipeline 3*a*. Then, the refrigerant is guided to, and discharges heat at the outdoor heat exchanger to external air, and introduced into the high pressure liquid refrigerant connection pipeline in the distributor through the check valve 7*a*.

Next, the refrigerant passed through the high pressure liquid refrigerant connection pipeline 21 is guided to the high pressure liquid refrigerant branch pipelines 22 branched as many as the number of indoor units, and introduced into the electronic expansion valves 61 in the indoor units. The high pressure liquid refrigerant introduced into the electronic expansion valve 61 expands at the electronic expansion valve 61, and absorbs heat as the refrigerant passes through the indoor heat exchanger 62.

The refrigerant passed through the indoor heat exchanger 62, low pressure refrigerant, flows through the low pressure gas refrigerant pipeline 26 in the distributor. Because, as shown in FIG. 4, the selection valve 31 on the high pressure gas refrigerant branch pipeline 24 is closed, and the selection valve 32 on the low pressure gas refrigerant branch pipeline 26 is opened. The selection valves are electronically controlled proper to operation modes.

The refrigerant passed through the low pressure gas refrigerant branch pipelines 26 comes together to the low pressure gas refrigerant connection pipeline 25, is guided to the third connection pipeline 6 in the indoor unit, and drawn into the compressor 1. The unexplained reference symbol 9 in FIG. 4 denotes an accumulator.

In the meantime, a portion of the high pressure gas refrigerant from the compressor 1 is introduced into the second connection pipeline 5 connected to the first connection pipeline 3*a*. However, since the selection valve 31 on the high pressure gas refrigerant branch pipeline 24 is closed, the high pressure gas refrigerant can not flow further, but stays. However, the staying refrigerant bypasses through the bypass pipeline 27*a* of the liquefaction preventing device 27 between the second connection pipeline 5 and the low pressure gas refrigerant connection pipeline 25, and passes through, and converted into gas refrigerant at the electronic expansion valve 27*b*.

The electronic expansion valve 27*b* on the bypass pipe 27*a* controls an opening thereof for converting the high pressure gas refrigerant staying in the second connection pipeline 5 into a low pressure gas refrigerant, and drawn into the compressor 1 again via the low pressure refrigerant connection pipeline 25.

Refrigerant flow after introduced into the low pressure gas refrigerant connection pipeline 25 is the same as described before.

Next, the operation of the foregoing defrosting device will be described.

When both the first and second three way valves 82 and 92 close all flow passages completely, the system cools the rooms according to the foregoing refrigerant flow.

Next, referring to FIG. 4, when the first three way valve 82 is opened to make only the first bypass pipe 81 and the defrosting heat exchanger 71 in communication, and the second three way valve 92 is opened to make only the defrosting heat exchanger 71 and the second bypass pipe 81 in communication, the high pressure liquid refrigerant is introduced into the defrosting heat exchanger 71 through the first bypass pipe 71, and the defrosting heat exchanger 71 discharges heat to outdoor air like the outdoor heat exchanger 2.

The refrigerant from the defrosting heat exchanger passes the check valve 7*a* on the first connection pipeline, and is guided to the distributor 'B'. The refrigerant flow thereafter is the same with prior description.

Second, referring to FIG. 5, refrigerant flow in the second mode of the multi-type air conditioner in accordance with a first preferred embodiment of the present invention will be described.

Most of the high pressure gas refrigerant from the compressor 1 is introduced into the four way valve 60 via the first connection pipeline 3*a*. Then, the refrigerant is guided to, and discharges heat to the outdoor air at, the outdoor heat exchanger 2, and introduced into the high pressure liquid refrigerant connection pipeline 21 in the distributor via the check valve 7*a*. The operation thereafter is the same with the first mode, which will be omitted.

In the meantime, a small portion of refrigerant, excluding the high pressure gas refrigerant introduced into the four way valve 60, is guided to the high pressure gas refrigerant connection pipeline 23 in the distributor through the second connection pipeline 4. Different from the first mode, in the second mode, since the electronic expansion valve 27*b* of the liquefaction preventing device 27 is closed, no refrigerant is introduced into the low pressure gas refrigerant connection pipeline 25.

In the meantime, when the room to be heated is C3, opposite to the room to be cooled, of the selection valves of the distributor connected to C3, the selection valve 31*c* on the high pressure refrigerant branch pipeline is opened, and the selection valve 32*c* on the low pressure refrigerant branch pipeline is closed, such that the refrigerant through the high pressure gas refrigerant connection pipeline 23 is guided to the high pressure gas refrigerant branch pipeline 24*c* connected to the room that requires heating.

The refrigerant guided to the high pressure gas refrigerant branch pipeline 24*c* is introduced into, and discharges heat at, the indoor heat exchanger 62*c*, and introduced into the high pressure liquid refrigerant branch pipeline 22*c* connected to the indoor unit.

The refrigerant guided through the high pressure liquid refrigerant branch pipeline 22*c* joins with the refrigerant flowing through the outdoor heat exchanger 3 at the high pressure liquid refrigerant connection pipeline 21. A process thereafter is the same with the first mode.

In the meantime, in this mode, the operation of the defrosting device, the same with the first mode, will be omitted.

Figure 6:
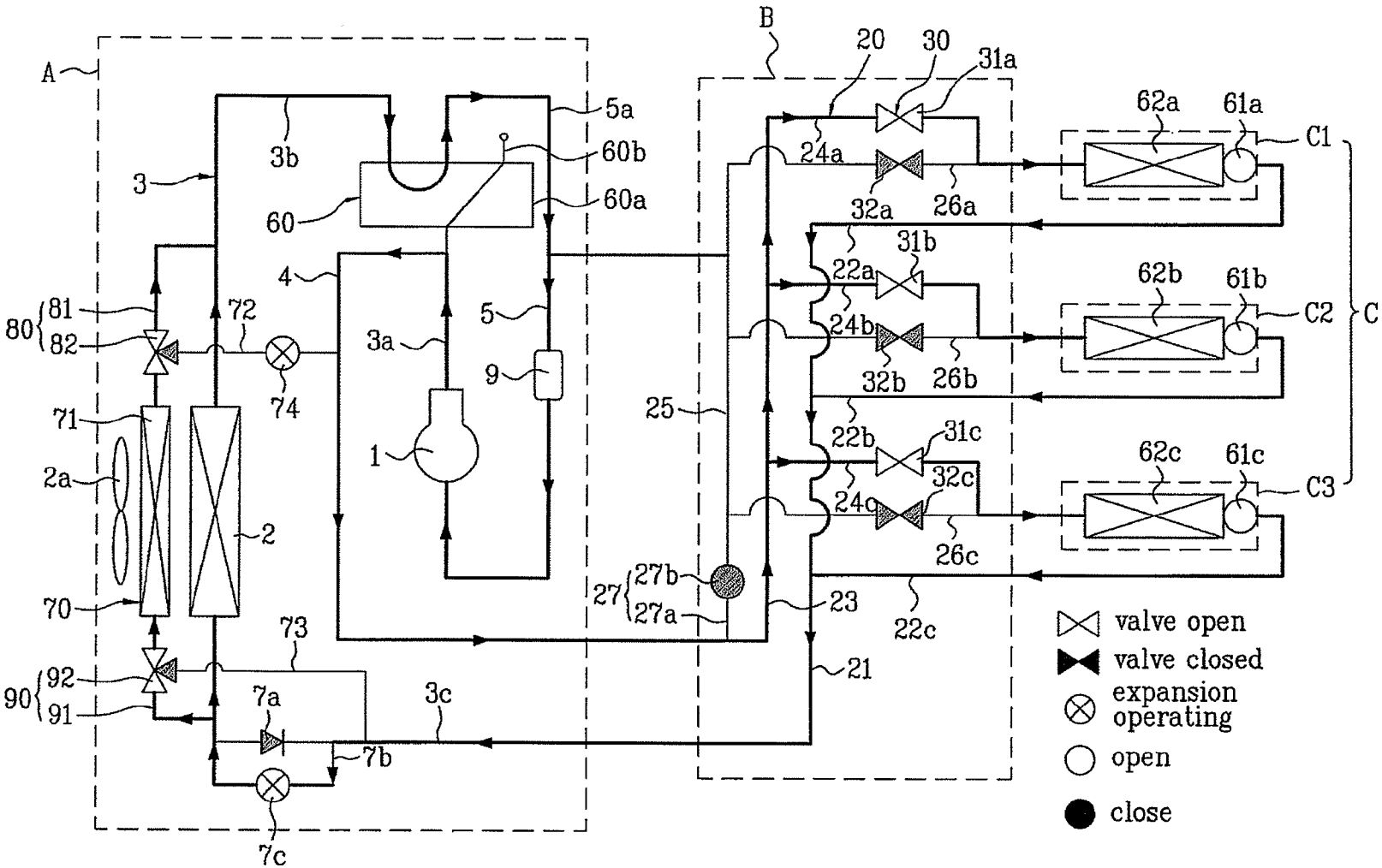
FIG. 6 illustrates a diagram showing a state a multi-type air conditioner with a defrosting device in accordance with a first preferred embodiment of the present invention is operated in a third mode.

Third, referring to FIG. 6, refrigerant flow in the third mode of the multi-type air conditioner in accordance with a first preferred embodiment of the present invention will be described.

Most of the high pressure gas refrigerant from the compressor 1 is guided to the second connection pipeline 4 via the first connection pipeline 3*a* by the four way valve 60. The introduced refrigerant is guided to the high pressure gas refrigerant connection pipeline 23 in the distributor, directly. The refrigerant guided to the high pressure gas refrigerant connection pipeline 23 is introduced into to the high pressure refrigerant branch pipelines 24 to respective indoor units.

In the third mode, opposite to the first mode, of the electronically controlled selection valves in the distributor, the selection valves 31 on the high pressure gas refrigerant branch pipelines 24 are opened, and the selection valves 32 on the low pressure gas refrigerant branch pipelines 26 are closed, so that the refrigerant flows through the high pressure gas refrigerant branch pipelines 24, and is introduced into, and discharges heat at, the indoor heat exchangers 62.

The high pressure liquid refrigerant from the indoor heat exchangers passes through the fully opened electronic expansion valves 61, is guided to the high pressure liquid refrigerant branch pipelines 22 and the high pressure refrigerant connection pipeline 21, and flows through the first connection pipeline 3*c* of the outdoor unit.

The refrigerant guided through the first connection pipeline 3*c* passes the electronic expansion valve 7*c* on the parallel pipe 7*b* mounted parallel to the check valve 7*a*, and introduced into the outdoor heat exchanger 2. This is because, in the third mode, the check valve 11 is closed.

The refrigerant introduced into, and absorbs heat at, the outdoor heat exchanger 2, and is introduced into the four way valve 60 via the first connection pipeline 3*b*. The refrigerant introduced into the four way valve 60 is drawn into the compressor 1 via a branch pipeline 5*a* from the third connection pipeline and the third connection pipeline.

Next, the operation of the defrosting device in this mode will be described.

When the first three way valve 82 closes all flow passages completely, the present system heats the rooms according to the refrigerant flow described already.

Figure 5:
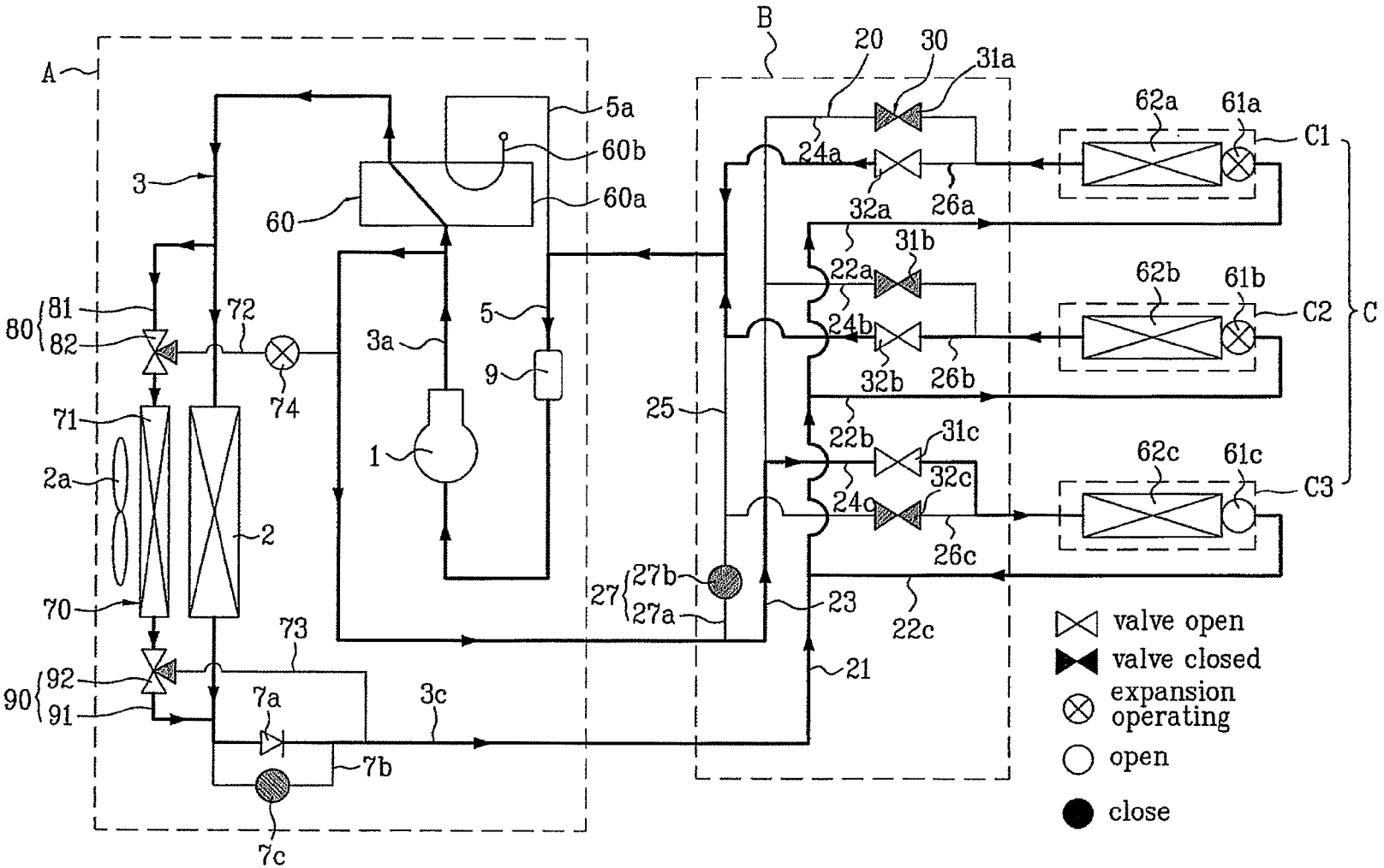
FIG. 5 illustrates a diagram showing a state a multi-type air conditioner with a defrosting device in accordance with a first preferred embodiment of the present invention is operated in a second mode.

Next, as shown in FIG. 5, when the three way valve 81 is opened to make the first bypass pipe 82 and the defrosting heat exchanger 71 in communication, and the second three way valve 92 is opened to make the defrosting heat exchanger 71 and the second bypass pipeline 91 in communication, the refrigerant flowing through the first connection pipeline passes through the parallel expansion pipe 7*b*, and introduced into the defrosting heat exchanger 71 through the second bypass pipe 91. The defrosting heat exchanger 71 serves as an evaporator like the outdoor heat exchanger 2. The refrigerant from the defrosting heat exchanger 71 is guided to the first connection pipeline 3*b* through the first bypass pipe 71.

A process thereafter is identical to the flow of high pressure liquid refrigerant flowing through the first connection pipeline 3 from the outdoor heat exchanger in this mode.

Figure 7:
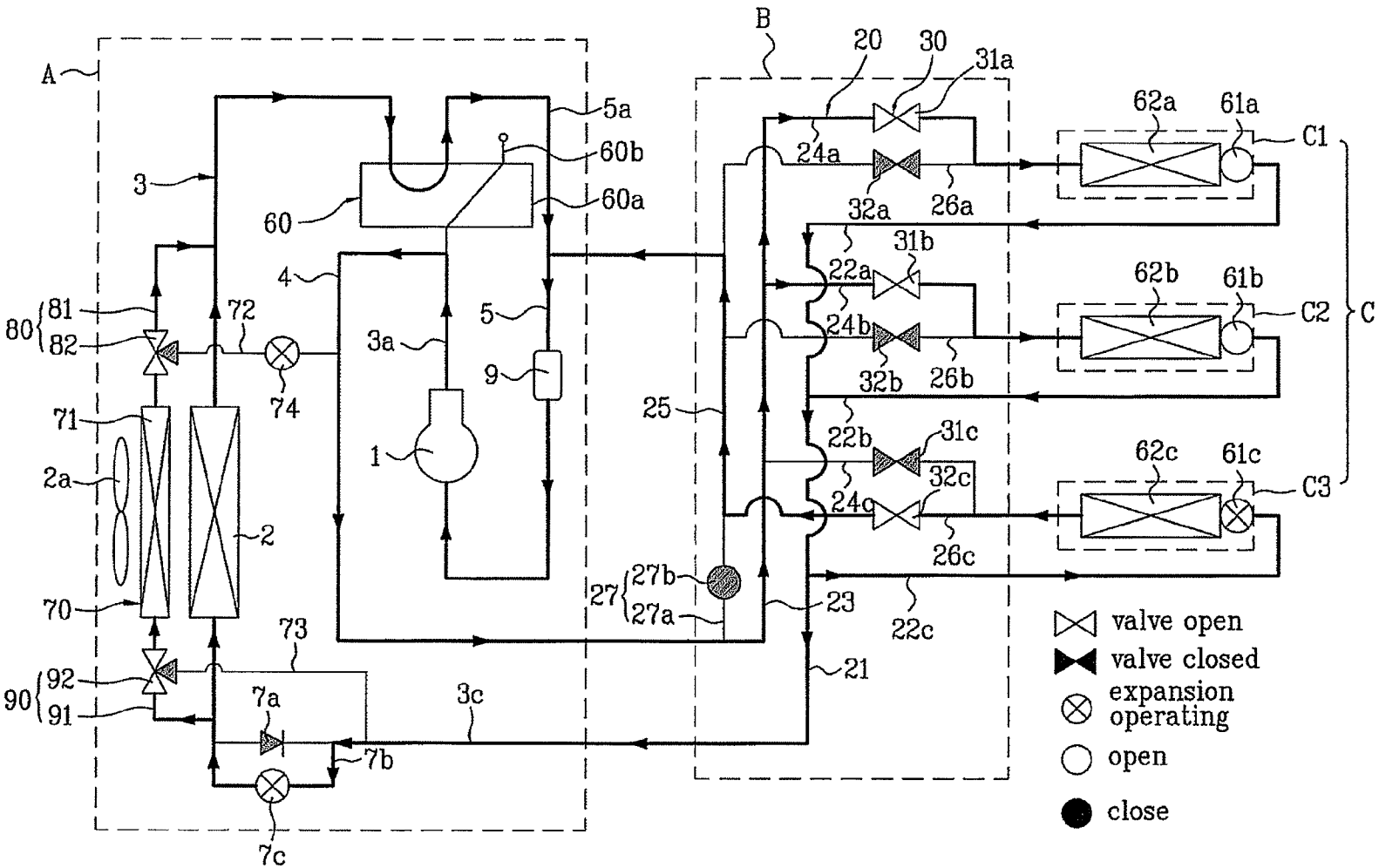
FIG. 7 illustrates a diagram showing a state a multi-type air conditioner with a defrosting device in accordance with a first preferred embodiment of the present invention is operated in a fourth mode.

Fourth, referring to FIG. 7, the refrigerant flow in the fourth mode in the multi-type air conditioner in accordance with a first preferred embodiment of the present invention will be described.

Most of the high pressure gas refrigerant from the compressor 1 is introduced into the distributor through the second connection pipeline 4. If the rooms that require heating are C1 and C2, and a room that requires cooling is C3, the introduced refrigerant passes through the high pressure gas refrigerant connection pipeline 23, and introduced into, and discharges heat at, the indoor heat exchangers 62*a*, and 62*b* in the indoor units in the rooms C2 and C3 that require heating through the high pressure refrigerant branch pipelines 24 under the control of the selection valves in the distributor. Then, the refrigerant passes through the fully opened electronic expansion valves 61*a* and 61*b*, and flows through the high pressure liquid refrigerant branch pipelines 22*a* and 22*b* and the high pressure liquid refrigerant connection pipeline 21.

In the meantime, opposite to the rooms that require heating, of the selection valves in the distributor connected to the room C3 that requires cooling, the selection valve 31*c* on the high pressure gas refrigerant branch pipeline 24*c* is closed, and the selection valve 32*c* on the low pressure gas refrigerant branch pipeline 26*c* is opened, such that a portion of high pressure liquid refrigerant in the refrigerant flowing through the high pressure liquid refrigerant connection pipeline 21 is guided to the high pressure liquid refrigerant branch pipeline 22*c* connected to the room C3 that requires cooling. Flow of the rest of the refrigerant excluding the portion of high pressure liquid refrigerant guided to the high pressure liquid refrigerant branch pipeline 22*c* is identical to the case of the third mode, of which description will be omitted.

The refrigerant guided to the high pressure liquid refrigerant branch pipeline 22*c* is expanded at the electronic expansion valve 61*c* in the indoor unit in the room that requires cooling, introduced into, and absorbs heat at, the indoor heat exchanger 62*c*, and flows to the opened low pressure liquid refrigerant branch pipeline 26*c*.

The low pressure gas refrigerant flowing through the low pressure gas refrigerant branch pipeline 26*c* passes through the low pressure gas refrigerant connection pipeline 25, joins with the refrigerant flowing through the outdoor heat exchanger 2 at the third connection pipeline 5, and drawn into the compressor 1.

In the meantime, in this mode, the operation of the defrosting device is the same with the defrosting device in the third mode, of which description will be omitted.

Fifth, referring to FIG. 8, the refrigerant flow in the fifth mode in the multi-type air conditioner in accordance with a first preferred embodiment of the present invention will be described.

In this mode, since operation of the part of the multi-type air conditioner excluding the defrosting device 71 is identical to the third mode, description of the identical part will be omitted.

For the defrosting device 71 in the multi-type air conditioner in accordance with the embodiment of the present invention to carry out defrosting function, the electronic valve 74 on the first guide pipeline 72 is opened and controls a flow rate, the three way valve 82 is opened such that the refrigerant flowing through the first guide pipeline 72 is introduced into the defrosting heat exchanger 71, and the valve on the first bypass pipe 81 is closed.

The second three way valve 92 is opened such that the refrigerant from the defrosting heat exchanger 71 is guided to the first connection pipeline 3*c* through the second guide pipeline 73, and the valve on the second bypass pipe 91 is closed.

According to the foregoing operation of the electronic valve 74 on the first guide pipeline, the first three way valve 82, and the second three way valve 92, a portion of the high pressure gas refrigerant from the compressor 1 passes through the first guide pipeline 72, the first three way valve 82, the defrosting heat exchanger 71, the second three way valve 92, and the second guide pipeline 73 in succession, and is guided to the first connection pipeline 3*c*. the refrigerant guided to the first connection pipeline passes through, and expanded at, the parallel expansion pipe 7*b*, and introduced into the outdoor heat exchanger 2. Refrigerant flow thereafter is identical to the third mode.

The high pressure liquid refrigerant introduced into the defrosting heat exchanger discharges heat, which heat removes the frost from the outdoor heat exchanger.

Sixth, referring to FIG. 9, the refrigerant flow in the sixth mode of the multi-type air conditioner in accordance with a first preferred embodiment of the present invention will be described.

Figure 9:
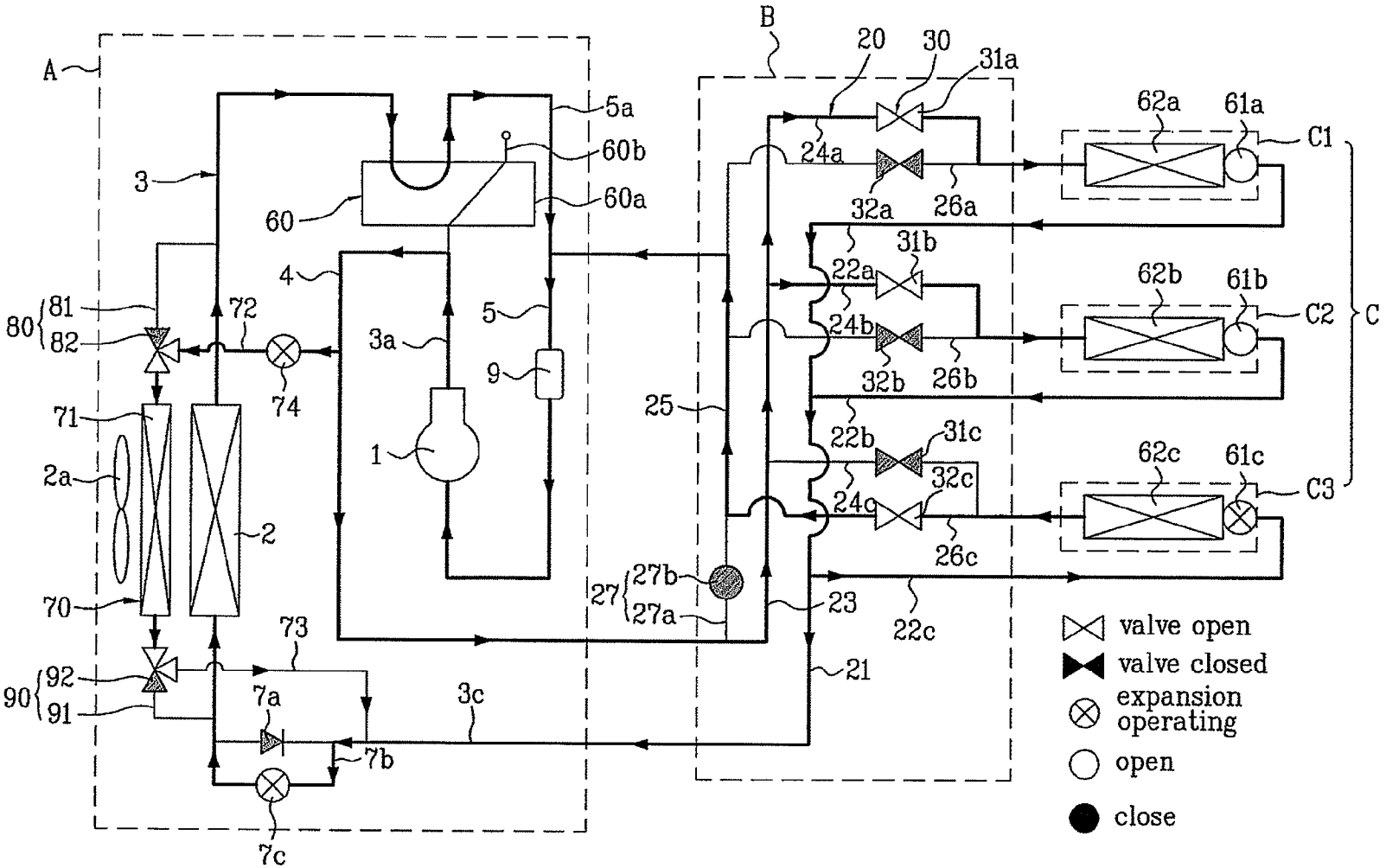
FIG. 9 illustrates a diagram showing a state a multi-type air conditioner with a defrosting device in accordance with a first preferred embodiment of the present invention is operated in a fourth mode, and the defrosting device is in operation.

In this mode, since operation of the part of the multi-type air conditioner excluding the defrosting device 71 is identical to the fifth mode, and the operation of the defrosting device is identical to the fifth mode in the foregoing embodiment as shown in FIG. 9, description of the sixth mode will be omitted.

As has been described, the multi-type air conditioner with the defrosting device of the present invention has the following advantages.

First, the multi-type air conditioner of the present invention can deal with individual room condition in an optimal condition. All the operation modes of first mode for cooling all rooms, a second mode for cooling a major number of rooms and heating a minor number of rooms, a third mode for heating all rooms, and a fourth mode for heating a major number of rooms and cooling a minor number of rooms, are possible.

Second, as the multi-type air conditioner of the present invention comprises a defrosting device in the outdoor unit, to remove frost from the outdoor heat exchanger in the third or fourth mode, an air conditioning efficiency can be improved in comparison to the related art air conditioner, and the shift to an cooling mode in the middle of heating is not required for defrosting like the related art.

Third, because a separate heater can be dispensed with for removal of the frost from the outdoor heat exchanger, power consumption can be reduced.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A multi-type air conditioner comprising:

an outdoor unit including an outdoor heat exchanger configured to exchange heat between outdoor air and a refrigerant;

a plurality of indoor units connected to the outdoor unit;

a defrosting device configured to remove a frost from the surface of the outdoor heat exchanger in case that at least one indoor unit operates in a heating operation mode, said defrosting device comprising a defrosting heat exchanger adjacent to the outdoor heat exchanger;

a first guide pipeline configured to connect one end of the defrosting heat exchanger to a pipeline in which a high pressure gas refrigerant flows; and a second guide pipeline configured to connect the other end of the defrosting heat exchanger to a pipeline in which a high pressure liquid refrigerant flows.

2. The multi-type air conditioner according to claim 1, wherein the defrosting heat exchanger functions as a condenser or an evaporator selectively, according to an operating mode.

3. The multi-type air conditioner according to claim 1, wherein the defrosting device further comprises an electronic valve provided on the first guide pipeline to control a flow rate of the high pressure gas refrigerant.

4. The multi-type air conditioner according to claim 1, wherein the defrosting device further comprises:

a bypass pipe having one end connected to the first guide pipeline, and the other end is in fluid connection with a pipeline in which a low pressure gas refrigerant flows;

a three way valve provided on a connecting region at which the bypass pipe and the first guide pipeline meet; and, an expansion valve provided on the second guide pipeline to control a flow rate of the high pressure liquid refrigerant.

5. The multi-type air conditioner according to claim 1, wherein the defrosting device further comprises:

a first bypass pipe having one end connected to the first guide pipeline, and the other end is in fluid connection with a pipeline in which a low pressure gas refrigerant flows;

a first three way valve provided on a connecting region at which the first bypass pipe and the first guide pipeline meet;

a second bypass pipe having one end connected to the second guide pipeline, and the other end is in fluid connection with a pipeline in which a high pressure liquid refrigerant flows; and, a second three way valve provided on a connecting region at which the second bypass pipe and the second guide pipeline meet.

6. A multi-type air conditioner comprising:

an outdoor heat exchanger;

a defrosting heat exchanger configured to function as a condenser adjacent to the outdoor heat exchanger in order to remove a frost from a surface of the outdoor heat exchanger in case that the outdoor heat exchanger functions as an evaporator;

a first guide pipeline configured to connect one end of the defrosting heat exchanger to a pipeline in which a high pressure gas refrigerant flows; and a second guide pipeline configured to connect the other end of the defrosting heat exchanger to a pipeline in which a high pressure liquid refrigerant flows;

wherein the air conditioner is capable of cooling some rooms and heating other rooms simultaneously.

7. A multi-type air conditioner comprising:

a plurality of indoor units;

an outdoor unit connected to the indoor units, the outdoor unit comprising:

a compressor configured to compress a refrigerant; and a plurality of heat exchangers adjacent to the compressor;

a first guide pipeline configured to connect one end of one of the heat exchangers to a pipeline in which a high pressure gas refrigerant flows; and a second guide pipeline configured to connect the other end of the one of the heat exchangers to a pipeline in which a high pressure liquid refrigerant flows, wherein the one of the heat exchanger functions as a condenser when at least one indoor unit is heating a room.

* * * * *